US006817392B2

(12) United States Patent
Phillips

(10) Patent No.: US 6,817,392 B2
(45) Date of Patent: Nov. 16, 2004

(54) APPARATUS FOR SHAPING TIMBERS WITH IMPROVED TIMBER CONTROL

(75) Inventor: Stewart A. Phillips, Boonville, IN (US)

(73) Assignee: Mitek Holdings, Inc., Chesterfield, MO (US)

( * ) Notice: Subject to any disclaimer, the term of this patent is extended or adjusted under 35 U.S.C. 154(b) by 71 days.

(21) Appl. No.: 10/229,694

(22) Filed: Aug. 28, 2002

(65) Prior Publication Data

US 2004/0040622 A1 Mar. 4, 2004

(51) Int. Cl.[7] ..... B27C 1/08

(52) U.S. Cl. ..... 144/39; 144/1.1; 144/3.1; 144/41

(58) Field of Search ..... 144/2.1, 3.1, 154.1, 144/150, 117.1, 130, 218, 242.1, 245.2, 245.4, 1.1, 39, 41; 83/425.3, 425.4; 198/728, 732, 733

(56) References Cited

U.S. PATENT DOCUMENTS

| | | | | |
|---|---|---|---|---|
| 1,630,173 A | * | 5/1927 | Dumont | 144/134.1 |
| 2,751,944 A | * | 6/1956 | Schrag et al. | 144/134.1 |
| 3,072,159 A | | 1/1963 | Warmbrunn | |
| 3,867,803 A | | 2/1975 | Platt | |
| 4,100,949 A | * | 7/1978 | Carter | 144/402 |
| 4,193,431 A | | 3/1980 | Wood | |
| 4,220,241 A | | 9/1980 | DeGray | |
| 4,364,468 A | | 12/1982 | Hetra et al. | |
| 4,454,794 A | | 6/1984 | Thornton | |
| 4,552,049 A | | 11/1985 | Matzinger et al. | |
| 5,103,880 A | * | 4/1992 | Rice et al. | 144/3.1 |
| 5,730,195 A | | 3/1998 | Riesmeier et al. | |
| 6,176,060 B1 | | 1/2001 | Kennelly et al. | |
| 6,249,972 B1 | | 6/2001 | Kennelly et al. | |

FOREIGN PATENT DOCUMENTS

| | | |
|---|---|---|
| AU | 730275 | 10/2000 |
| AU | 755778 | 4/2001 |
| DE | 197 56 503 A1 | 12/1997 |
| EP | 1 142 679 A2 | 10/2001 |
| GB | 2 334 231 A | 8/1999 |
| WO | WO 02/28606 A1 | 4/2002 |

* cited by examiner

*Primary Examiner*—Allen Ostrager
*Assistant Examiner*—Shelley Self
(74) *Attorney, Agent, or Firm*—Senniger Powers

(57) ABSTRACT

An apparatus for forming workpieces with rounded ends especially for use as webs in timber roof trusses. The apparatus includes a feeding system for feeding workpieces into a row of workpieces arranged along a path of travel and cyclically advancing the row along the path to a rotary cutter tool. A movable conveyor receives workpieces thereon and delivers each workpiece sequentially to a loading position adjacent the upstream end of the path of travel. A pushing device is at the upstream end of the path. A common drive shaft simultaneously powers the conveyor and the pushing device. A stop bar prevents movement of the workpieces in a direction generally transverse the path of travel while the cutter tool is shaping the ends.

16 Claims, 11 Drawing Sheets

APPARATUS FOR SHAPING TIMBERS WITH IMPROVED TIMBER CONTROL

BACKGROUND OF THE INVENTION

This invention relates to an apparatus for shaping workpieces, for example, U.S. 2×4 inch timbers, with rounded ends especially for use as web members for trusses, being particularly concerned with an apparatus for cutting workpieces to such length as may be called for, and shaping the ends of workpieces to rounded form.

As is well known, timber roof trusses, such as Fink, Howe and Queenpost trusses, comprise upper and lower chords with web members extending therebetween triangulating the space between the chords, the chords and web members being fastened together by nailing plates. In much of the truss construction in the past, the webs have been fabricated with each end cut off straight at the requisite angle for engagement of the respective end flush with the respective chord (i.e. mitered). This has entailed a great deal of sawing with the requirement for cutting at different angles and the problem of organizing the cut timbers according to the mitering angles.

There has been a recent trend toward using webs with rounded ends instead of mitered ends, enabling the webs to be assembled in a truss extending at any of a wide range of angles with respect to a chord, in firm contact at a rounded end thereof with a chord. This has led to the desirability of manufacture of webs (e.g. 2×4 timbers) with both ends rounded (i.e. of generally semi-circular conformation) at a relatively high rate of production and at relatively low cost for realization of cost savings in truss manufacture.

Some devices for shaping workpieces, such as timbers, include a feeding system which delivers workpieces to a queue, or loading position, from where they are inserted one at a time into an aligned, horizontal row arrangement. An advancing mechanism advances the row of workpieces along a track leading toward a saw or other shaping tool. Upon each advance, the row is indexed downstream and one new workpiece may be received from the feeder into the row. Typically, the feeder operates in continuous motion (e.g., a constantly moving conveyor) while the advancing mechanism operates in reciprocal or cyclic motion and, consequently, the feeder and advancing mechanism are separately driven and independently powered. For example, the feeder is powered by an electric motor, while the advancing mechanism features hydraulically powered actuators with associated hydraulic reservoir and hoses. Unfortunately, that dual drive results in increased cost and complexity.

A second drawback relates to the shaping tool which rounds ends of workpieces to a semi-circular form. That tool is typically a rotatable, two-dimensional profile bladed cutter which includes upper and lower cutting blades for removing material from tops and bottoms of the ends, but not from central regions. The blades have shapes which, when cutting a workpiece, impart forces on the workpiece in a direction transverse to its intended path of motion. Consequently, the workpiece has a tendency to move laterally outward, away from the aligned row of workpieces and into a position between the upper and lower blades where it collides with a hub of the tool or other part. That causes the machine to jam and results in costly downtime.

BRIEF SUMMARY OF THE INVENTION

Accordingly, among the several objects of the invention may be noted the provision of an apparatus for forming workpieces with rounded ends at a relatively high rate of production and at relatively low cost; the provision of such an apparatus which has a drive system common to both feeding and indexing workpieces toward a cutting tool; the provision of such an apparatus which prevents lateral movement of a workpiece while being cut by the cutting tool; the provision of such an apparatus for production of workpieces of different lengths; and the provision of such a method and apparatus for reliable and economical rounded-end truss web member production.

In general, an apparatus of the present invention shapes an end of a workpiece as the workpiece is advanced along a path of travel. The apparatus comprises a frame defining the path of travel for the workpiece, and a rotary cutter positioned laterally adjacent the path for engaging the workpiece as it moves along the path. The cutter has a hub with upper and lower cutting arms extending outwardly from the hub for shaping upper and lower portions, respectively, of the end of the workpiece. The cutting arms have arcuate cutting edges and generally define a concave recess spaced between the upper and lower arms. A stop bar is mounted on the frame for preventing movement of the workpiece in a direction generally transverse the path of travel while the cutter is shaping the end of the workpiece. The stop bar is positioned adjacent to the path of travel and configured for engagement by the end of the workpiece if the workpiece should move in the transverse direction. The stop bar has a downstream end which extends into the concave recess of the cutter without contacting the cutter for supporting the workpiece against lateral movement while the workpiece is being cut by the cutter.

In another aspect, a feeding system of the invention is for feeding workpieces into a row of workpieces arranged along a path of travel and cyclically advancing the row along the path toward a downstream cutting machine. The system comprises an elongate frame defining the path of travel, the path having an upstream end and a downstream end. A conveyor is on the frame for receiving the workpieces thereon and delivering each workpiece sequentially to a loading position adjacent the upstream end of the path of travel. A pushing device is at the upstream end of the path. The pushing device is cyclically movable between an extended position wherein the pushing device engages a workpiece at an endmost upstream position of the row to lengthwise advance the row of workpieces along the path in the downstream direction, and a retracted position wherein a workpiece at the loading position may be deposited into the row at the endmost upstream position. A drive is for simultaneously driving the conveyor and the pushing device. The drive is operatively connected to the conveyor for moving the conveyor continuously in generally unidirectional motion and operatively connected to the pushing device for moving the pushing device in reciprocating motion between the extended and retracted positions for moving the workpieces along the path.

In yet another aspect, apparatus of the present invention is for feeding workpieces into a row of workpieces arranged along a path of travel and advancing the row along the path to a cutting machine for shaping the workpieces. The apparatus comprises a frame, the cutting machine, and a conveyor on the frame for receiving the workpieces thereon and delivering each workpiece sequentially to a loading position adjacent an upstream end of the path of travel. A pushing device is at the upstream end of the path comprising a slidably mounted bar, a connecting rod connected to the bar for moving the pushing device in reciprocating motion, and a disk having an offset crank pin attached to the connecting rod for movement. The pushing device is reciprocal between an extended position wherein the bar engages a workpiece at an endmost upstream position of the row to lengthwise advance the row of workpieces along the path in the downstream direction and through the cutting machine, and a retracted position wherein a workpiece at the loading position may be inserted into the row at the endmost upstream position.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
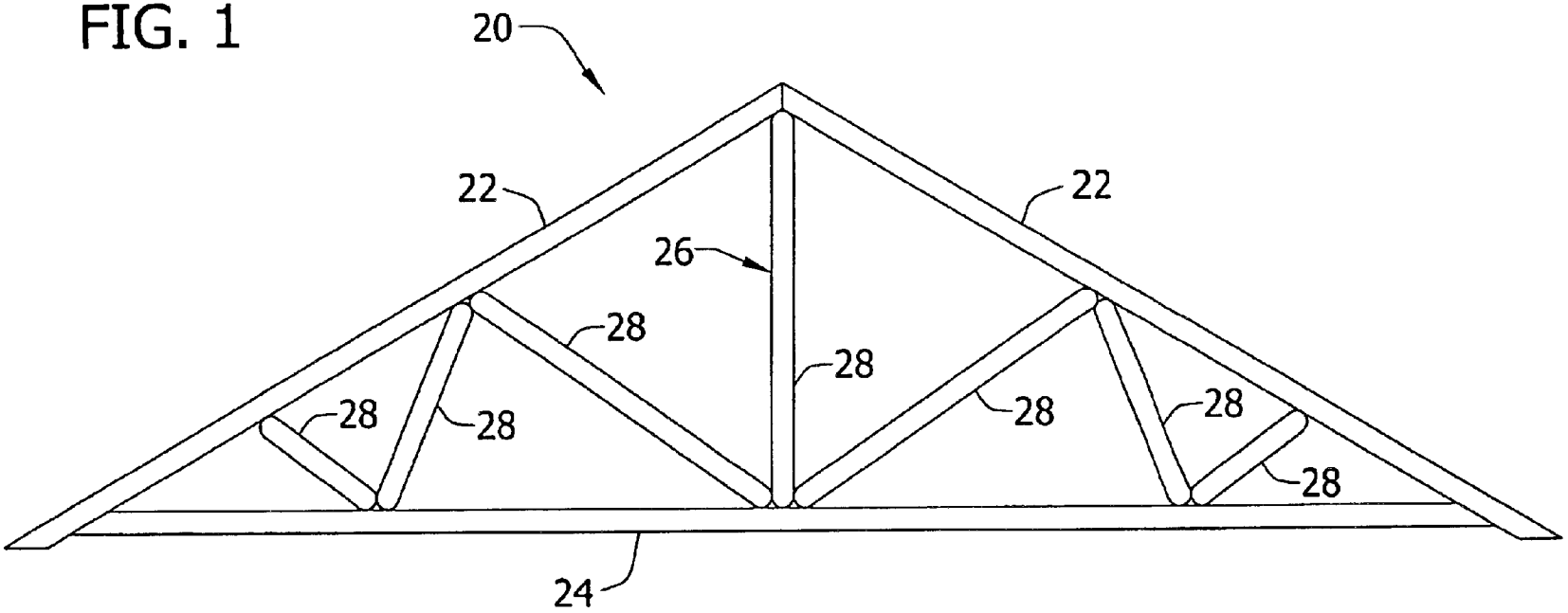
FIG. 1 is a diagrammatic view of a roof truss which includes rounded end webs shaped by apparatus of the present invention.
Figure 2:
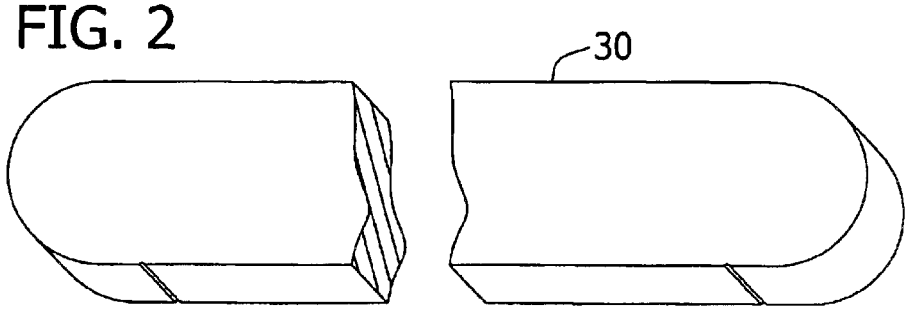
FIG. 2 is a view generally in perspective, and broken away in the middle, of one of the workpieces, taken generally on line 2—2 of FIG. 3.

Referring first to FIG. 1 of the drawings, there is illustrated a timber truss indicated generally at 20, more particularly a modified Queenpost truss, having upper chords 22, a lower chord 24, and a web 26 triangulating the triangular space between the upper chords and the lower chord. The web 26 is made up of web members 28 extending between the lower chord 24 and one of the upper chords 22. The lower chord 24, each of the upper chords 22, and each of the web members 28 are constituted, for example, by a length of 2×4 inch (nominal) timbers with the 4 inch sides being in vertical planes. As illustrated, each web member 28 has rounded ends (i.e., being curved generally in a semi-circle from one side to the other of the respective web member) in contact with a respective chord member at the respective panel point and fastened thereto by a nailing plate (not shown) in known manner. This is illustrated to show how the rounded-end web members 28 are used instead of mitered-end web members, and the format of webs of the type produced by the apparatus of this invention. FIG. 2 shows a web member 28 per se with the rounded ends. It is to be understood that the rounded end web members 28 could be used for constructing frames and items other than a roof truss, and that the apparatus can be used for shaping workpieces other than those made of wood, without departing from the scope of the present invention. Moreover, the precise dimensions of the web members could be other than 2×4 inches. As discussed below, the apparatus of the present invention may be adjusted to accommodate workpieces (not shown) of different cross sectional sizes and lengths.

A similar apparatus to the present invention for shaping workpieces is disclosed in co-assigned pending PCT application number PCT/US01/31235, filed Oct. 5, 2001, and entitled "Method Of And Apparatus For Forming Timbers With Rounded Ends," which is hereby incorporated by reference. That PCT application claims priority from U.S. provisional patent application No. 60/238,717, filed Oct. 6, 2000, which is also incorporated by reference.

Figure 3:
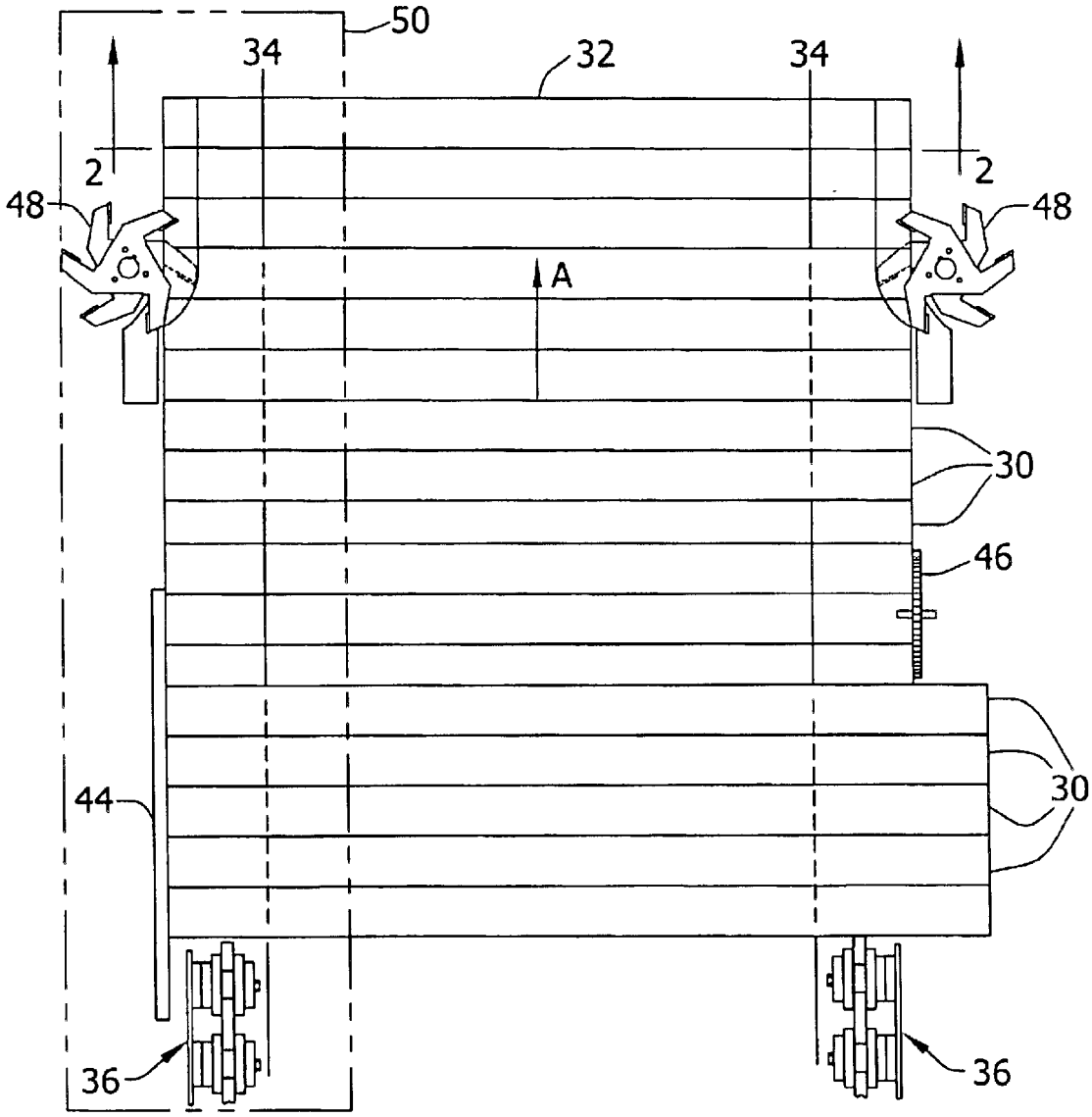
FIG. 3 is a schematic view generally illustrating (in plan) a row of workpieces and certain components of the apparatus.

Now referring principally to FIG. 3, the shaping of timbers 30 (broadly, "workpieces") with rounded ends is generally schematically shown to comprise feeding timbers arranged in a horizontal row 32 along a predetermined path of travel as indicated by the arrow A with the timbers extending transversely to the direction of feed. The path of travel is defined by left and right hand rails 34 upon which the timbers are slidably movable. A pushing device, indicated generally at 36, is engageable with the timber 30 at an upstream end position of the row 32 for advancing the timbers ahead in the stated path. The timbers 30 are organized in engagement with one another with the broad (4 inch) sides thereof in face-to-face engagement. As so organized, the row 32 of timbers is pushed as a group in the direction perpendicular to the broad sides of the timbers, sliding ahead in a generally horizontal plane over the left- and right-hand rails 34. However, it is to be understood that the timbers 30 may be otherwise oriented (e.g., with the narrower ends in engagement) without departing from the scope of the present invention. The pushing device 36 may be termed an advancing mechanism which indexes the row 32 downstream and permits a new timber to be received at the upstream end of the row. As will be described hereinafter, a conveyor 40 delivers timbers to a loading position 42 from where they may be received, one at a time and one after another, into the row 32.

The timbers 30 are butted up at one longitudinal end thereof (its left end as viewed in FIG. 3) against a guide or abutment constituted by a plate 44 that may be termed a "lumber stop" engageable by each timber for locating it endwise and guiding it along the path of travel. As the timbers 30 are pushed along the rails 34, the timbers are cut to a predetermined length as by a saw 46 (e.g., a rotary cross-cut saw) rotatable on an axis transverse to the path, the saw having a blade rotatable in a plane perpendicular to the timbers 30 for sawing off end portions of the timbers which project to the right of the saw as illustrated. The saw 46 is positioned in a plane spaced from the plate 44 a distance corresponding to and slightly greater than a selected length for the timbers 30.

As each timber 30 now having been cut to the predetermined length by the saw 46 continues being fed in the path of travel, it has both ends shaped to rounded form (semi-circular) by two shapers 48 on opposite sides of the path. Each shaper 48 is a rotary cutter for cutting the respective end of each timber 30 to the rounded form. The shapers 48 are located directly opposite one another on opposite sides of the path, both ends of each timber 30 being simultaneously cut thereby to the rounded form in a single pass of the timber. It is understood that the ends may be formed other than at the same time, or that only one end may be formed, without departing from the scope of the present invention.

The left-hand rail 34, the plate 44, and the left-hand shaper 48 are transversely movable, being mounted on a carrier or carriage 50 depicted in phantom in FIG. 3 mounted for adjustment toward and away from the right-hand rail 34 and saw 46 (which are transversely fixed) for engagement with timbers 30 of different lengths. This provides for transverse adjustment to cut web members of different length and round their ends.

Figure 4:
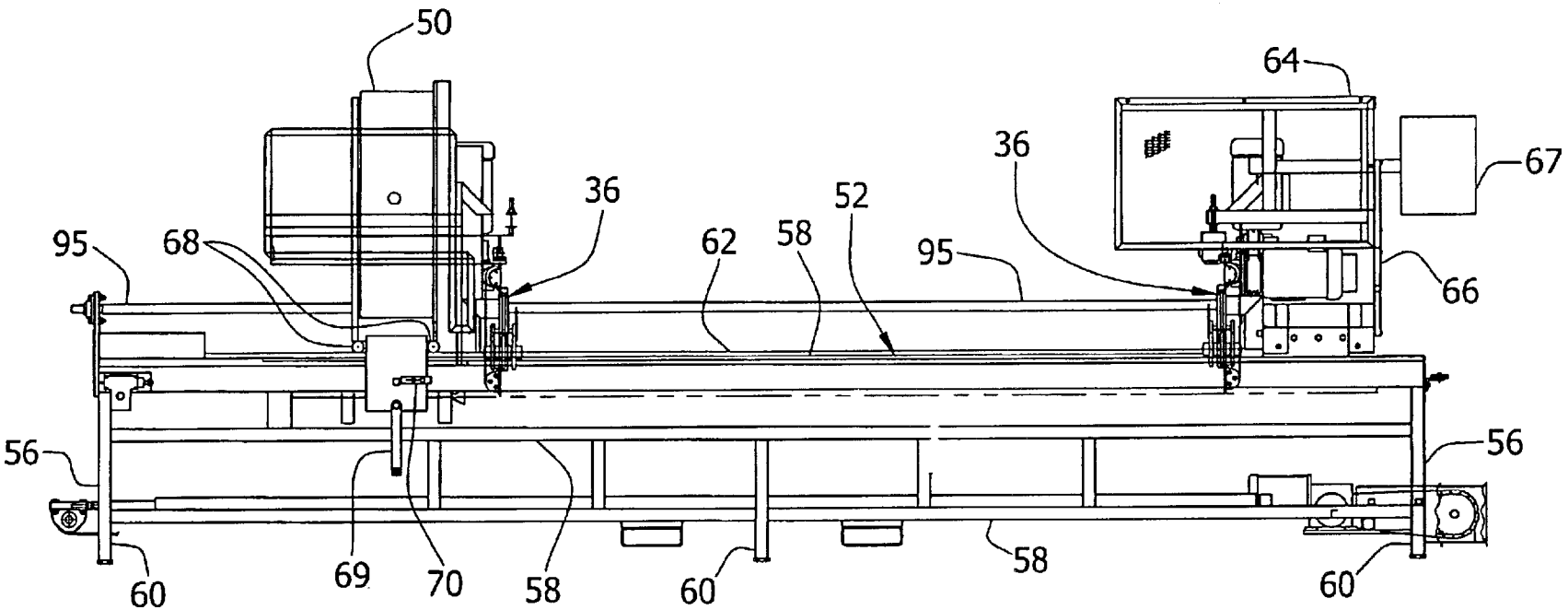
FIG. 4 is a view in elevation of apparatus of the invention as seen from what is termed the front of the apparatus.
Figure 5:
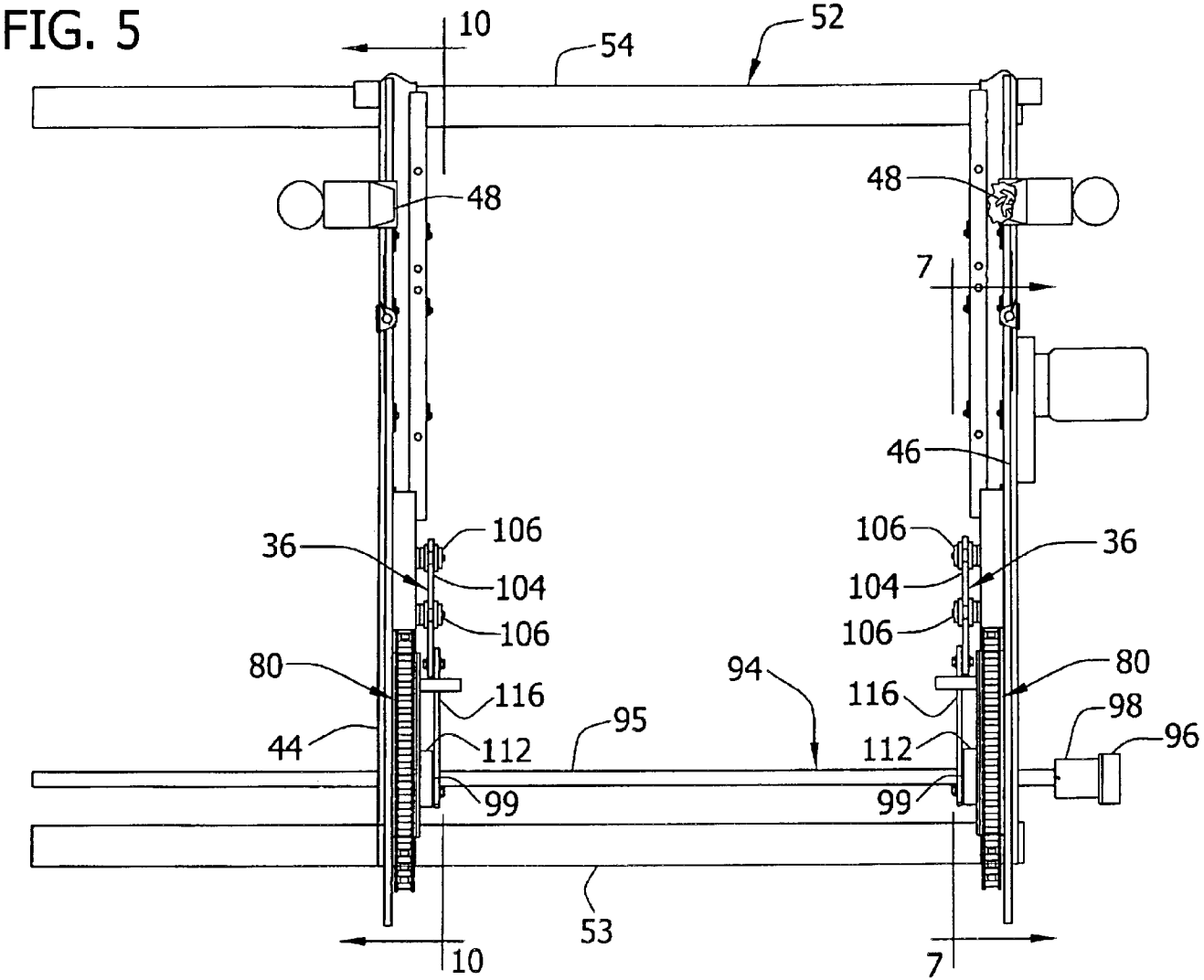
FIG. 5 is a view in plan of a portion of the apparatus.
Figure 6:
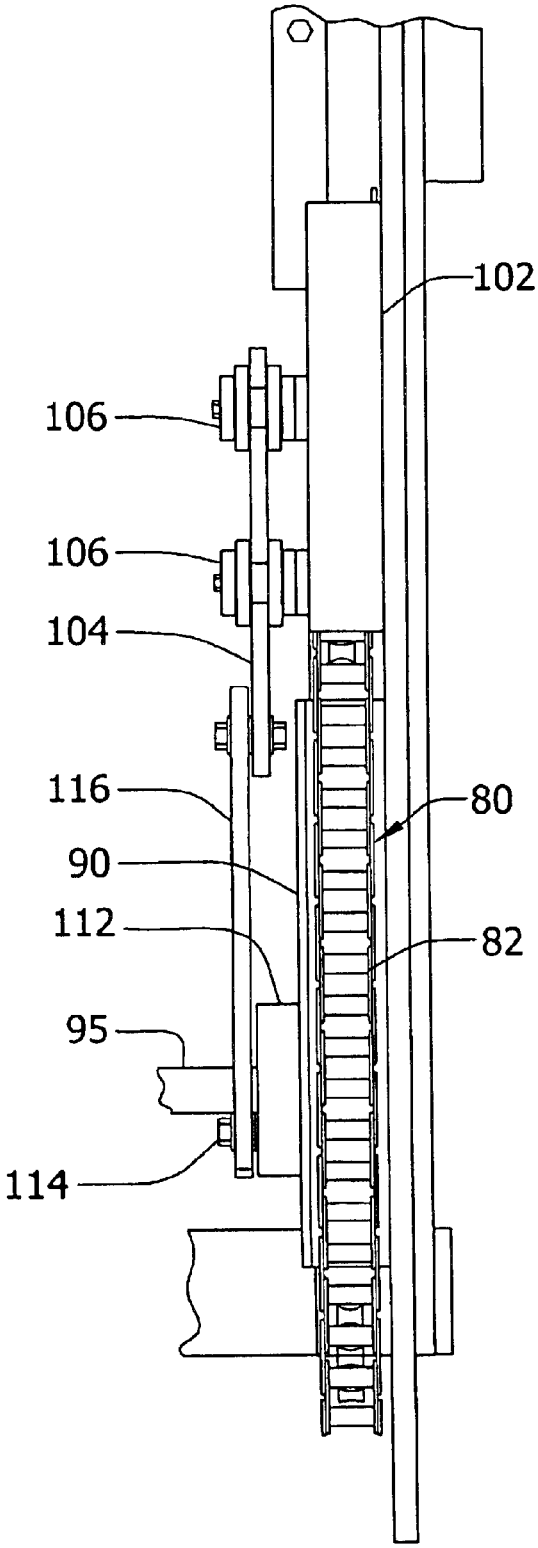
FIG. 6 is an enlarged portion of FIG. 5.

Now referring principally to FIGS. 4 and 5, apparatus of this invention which carries out the above-described shaping of timbers is shown to comprise the above-described pushing device 36, the plate 44, the shapers 48, and the saw 46. These components are mounted on an elongate frame, indicated generally at 52, having what may be termed a front 53, a back or rear 54, and opposite ends 56. The frame 52 comprises elongate box beams 58 extending from one end 56 to the other at the front 53 and rear 54 on legs 60. Extending lengthwise on top of one of the beams 58 is a rail 62 constituted by an elongate angle iron seated apex up on the beam. Adjacent one end 56 (the right end in FIG. 4) the frame has a timber-handling assembly 64, which may be referred to as the fixed timber-handling assembly, comprising a superstructure on the frame 52. A cover 66 and control panel 67 are mounted on the superstructure.

The aforesaid carrier or carriage 50, along with components carried thereby may be referred to as the movable timber-handling assembly, being movable lengthwise (endwise of the frame 52, i.e., left to right and vice versa) toward and away from the fixed timber-handling assembly 64 for cutting timbers 30 to different lengths as needed. The carriage 50 has grooved wheels 68 rolling on the rail 62. It is movable toward and away from the fixed timber-handling assembly 64 by manual operation of a crank 69 at the front end of a cross-shaft (not shown) geared at its front and rear ends to two of the wheels 68. The carriage 50 includes a locking mechanism 70 for locking the carriage in whatever position is needed.

Figure 10:
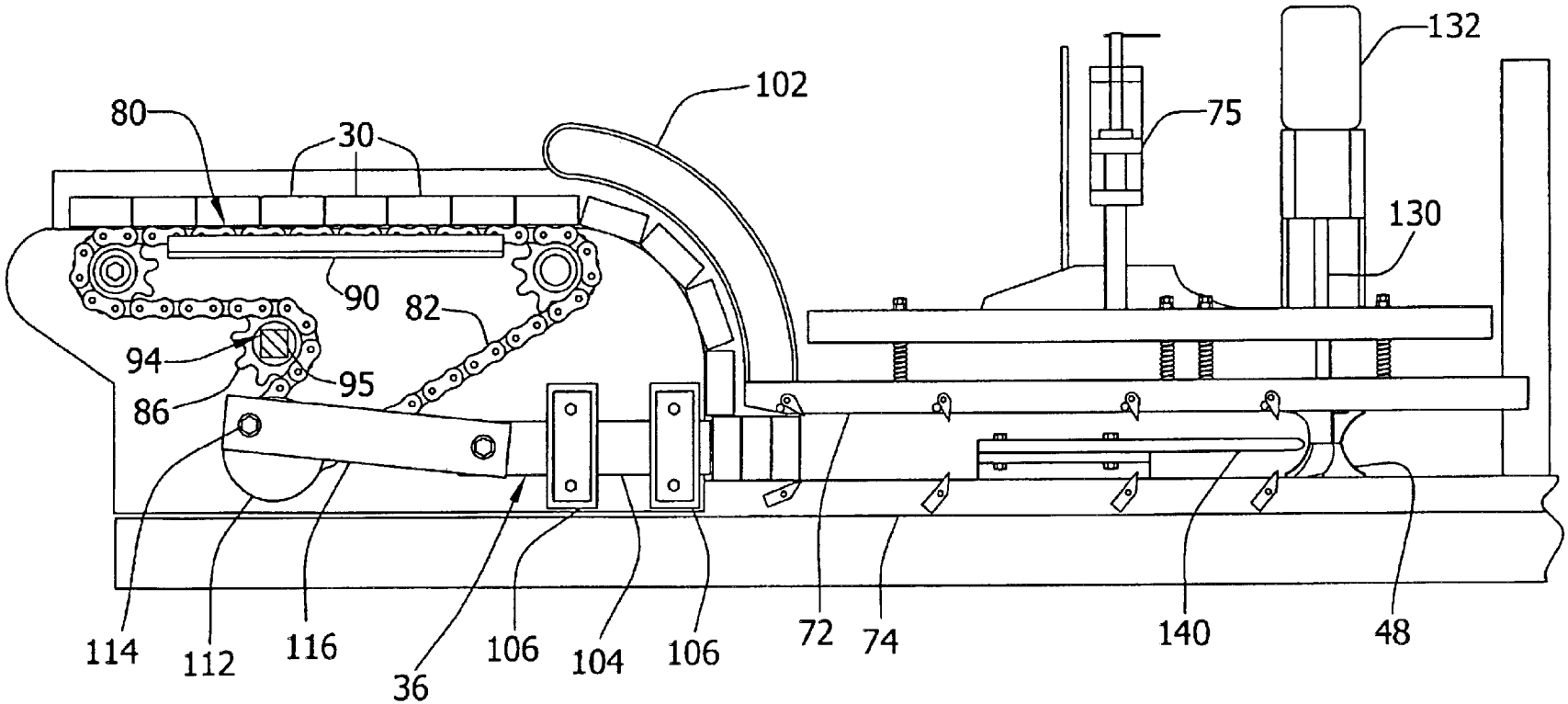
FIG. 10 is a view in elevation of the apparatus as seen along line 10—10 of FIG. 5.

The frame 52 includes an upper guide bar 72 and a lower guide bar 74 (FIG. 7), the timber 30 captured between the guide bars while moving along the path of travel. The upper guide bar 72 is adjustable in height for accommodating timbers 30 of different heights by manual turning of crank of an adjustment mechanism 75 (FIG. 10). No-return prongs 76 are mounted along the upper and lower guide bars 72, 74 to prevent any possibility of timbers 30 moving upstream (i.e., opposite to the arrow A of FIG. 3). Each prong 76 is a pointed tab which is engageable by the timbers 30 and permits downstream sliding movement of the timbers. Any upstream movement is opposed by the prong 76 which begins to be embedded in the timber 30. There may be any number of no-return prongs 76 (including zero) without departing from the scope of this invention.

Figure 7:
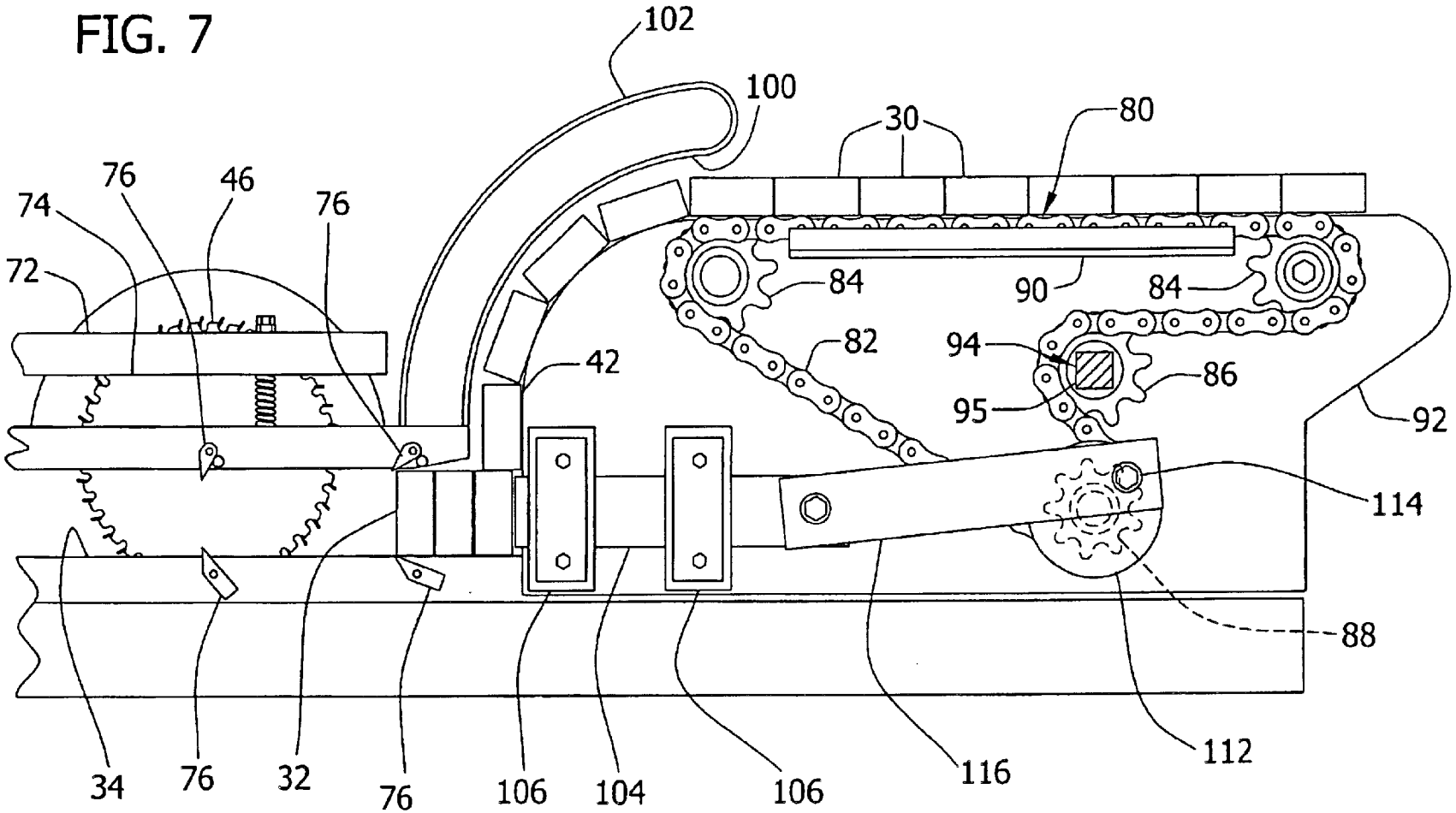
FIG. 7 is a view in elevation of the apparatus as seen along line 7—7 of FIG. 5 with a pushing device at a first position.

A conveyor is indicated generally at 80 and is mounted on the frame 52 for receiving timbers 30 thereon and delivering each timber sequentially to the loading position 42 adjacent the upstream end of the path of travel. The conveyor 80 includes a left-hand conveyor (FIG. 10) on the movable timber-handling assembly 50, and a right-hand conveyor (FIG. 7) on the fixed timber-handling assembly 64. The left- and right- hand conveyors 80 are substantially identical, so description hereinafter refers only to the right-hand conveyor, it being understood that the description is also applicable to the left-hand conveyor. Referring to FIG. 7, each of the left- and right- hand conveyors 80 comprises an upper reach of an endless chain 82. The chain 82 is wound around two conveyor sprockets 84, a drive sprocket 86, and a pusher sprocket 88. It is understood that another type of conveyor, such as a belt, does not depart from the scope of this invention. Moreover, the conveyor need not include any moving parts, such as a gravity-operated chute (not shown).

Each chain 82 is slidable lengthwise in a horizontal channel member 90 which guides the chain on its upper reach. The chain 82 is a conventional conveyor type chain which is sized and positioned such that it extends slightly above nearby wall member 92 so that when an operator places timbers 30 on the apparatus, the timbers rest on the chains and extend between the left- and right-hand chains. The conveyor 80 operates with unidirectional motion to move timbers from right to left as viewed in FIG. 7, and since both left- and right-hand chains 82 are commonly driven, they move at equal speeds.

A drive is indicated generally at 94 for driving both chains 82 of the conveyor 80. The drive 94 comprises a single long shaft 95 of non-round (e.g., square) cross-section extending from the left to the right end of the frame 52 through corresponding non-round openings in the sprockets 86. The drive further comprises an electric motor 96 (FIG. 5) with gearing system 98 for speed control. The shaft 95 is driven clockwise (as viewed in FIG. 7) to rotate sprockets 84 in a direction for effecting the travel in the feeding direction of the upper reaches of the chains 82. The drive shaft 95 is journalled in bearings 99 to the fixed and movable timber-handling assemblies 64, 50. It is understood that other configurations of a drive, such as a belt, chain, or round shaft, do not depart from the scope of this invention.

The conveyor 80 delivers the timbers 30 to the top of a guideway 100 defined between a downwardly sloped edge of the wall member 92 and an arcuate retainer 102 mounted on the frame 52. The guideway 100 comprises a gravity-fed magazine for queuing timbers 30 into a vertical orientation ready for insertion one at a time into the horizontal row 32. The retainer 102 holds the timbers' orientation relative to the guideway 100 as they are turned from a horizontal to a vertical position. The timbers 30 are delivered to a position at the bottom of the queue, which may be termed the loading position 42, and which is immediately above the horizontal row 32 of timbers at the upstream end. When the queue is full, the conveyor 80 may continue operating with the chain 82 slipping relative to and beneath generally stationary timbers 30 which are lined up on the conveyor.

Figure 8:
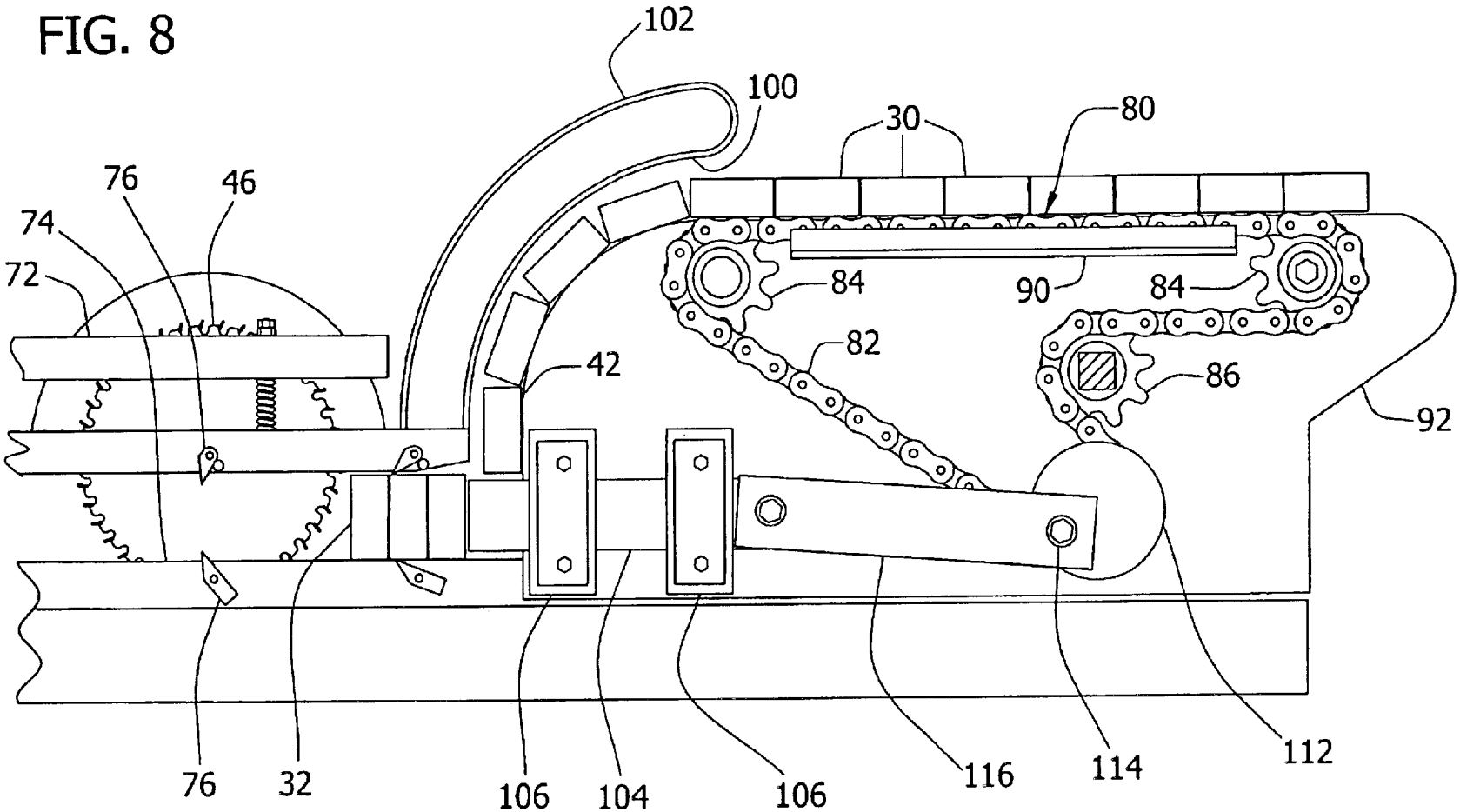
FIG. 8 is a view similar to FIG. 7 with the pushing device at a different position.
Figure 9:
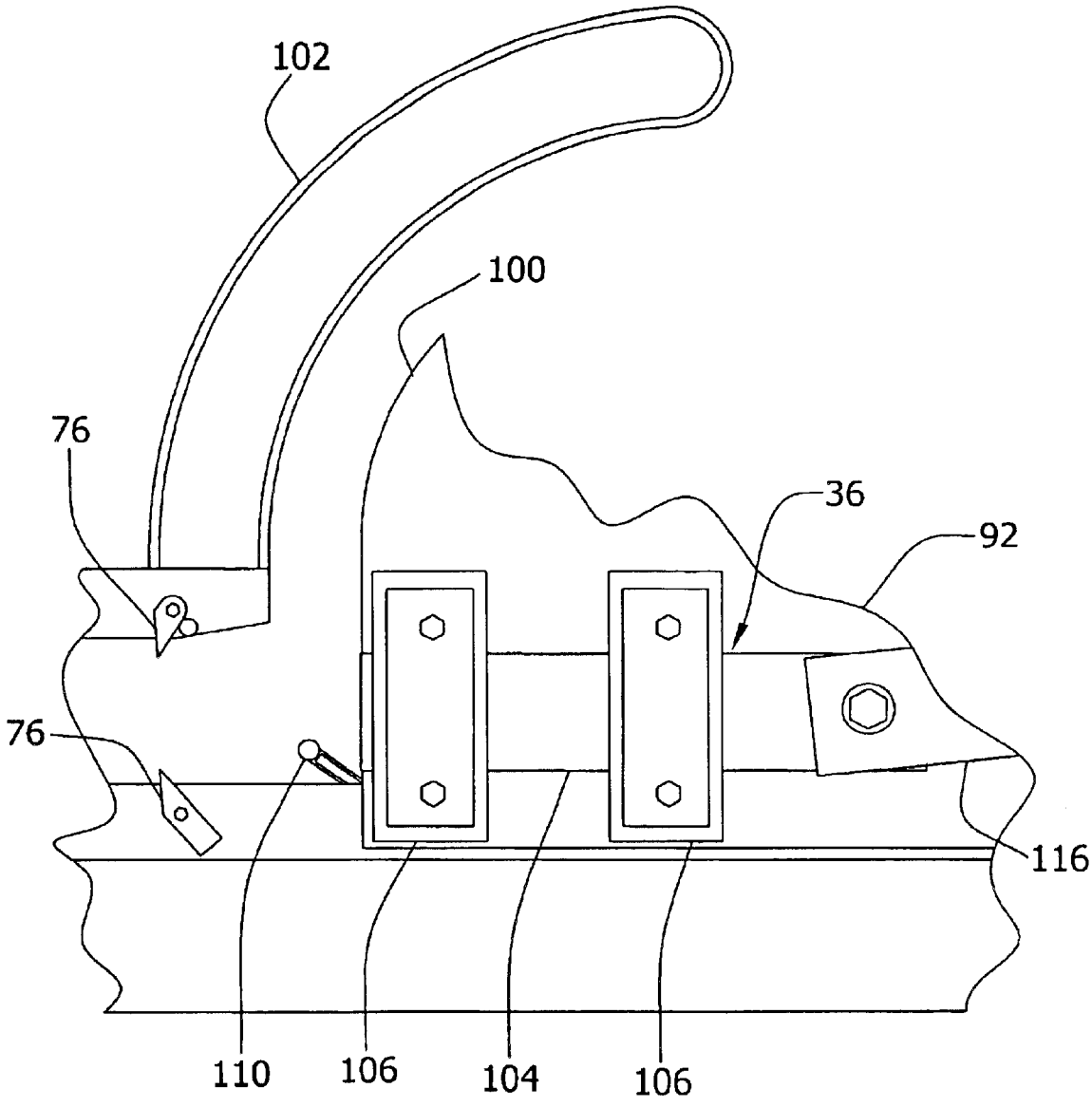
FIG. 9 is an enlarged elevation of a portion of the apparatus with the workpieces removed.

The pushing device 36 engages the timber 30 at the upstream end of the row 32 with sufficient force to push the row of timbers downstream, including sufficient force to push the row through the saw 46 and rotary shapers 48. The pushing device 36 comprises a generally flat bar 104 (one on each timber-handling assembly 50, 64) slidably held by two rectangular guide brackets 106 (FIG. 7). The bar 104 is generally thin and is oriented and sized for engaging timbers 30. Other configurations, sizes, or shapes do not depart from the scope of this invention. The pushing device 36 is reciprocally movable between an extended position (FIG. 8) wherein the bar 104 engages a timber 30 at the upstream end of the row 32 to advance the row of timbers along the path in the downstream direction, and a retracted position (FIG. 9) wherein the bar is retracted leaving an opening such that a timber at said loading position 42 may be deposited into the row at the upstream end of the row. The timber 30 at the loading position in the queue drops by gravity into the row. An intermediate position of the pushing device 36 is shown in FIG. 7. A conventional limit switch 110 (FIG. 9) is provided for sensing presence of a timber 30 at the upstream end of the row. If a timber 30 fails to drop into the row, the limit switch will shut down the motor 96 because no more timbers are queued in the guideway 100. There is one reciprocation of the pushing device 36 to the extended position for each timber 30 deposited into the row 32.

The pushing device 36 further comprises a rotatable disk 112 connected to the pusher sprocket 88 which is engaged with and driven by the chain 82. The disk 112 has an offset crank pin 114 attaching a connecting rod 116, the rod being connected to the bar 104 for moving the bar in reciprocal motion. Significantly, the pushing device 36 is powered by the same drive 94 as the conveyor 80. The shaft 95 moves the drive sprocket 86 to drive the chain 82, which in turn drives the pusher sprocket 88. The pushing of the timbers 30 is precisely timed in relation to the deposition of each new timber in the row 32.

Figure 11:
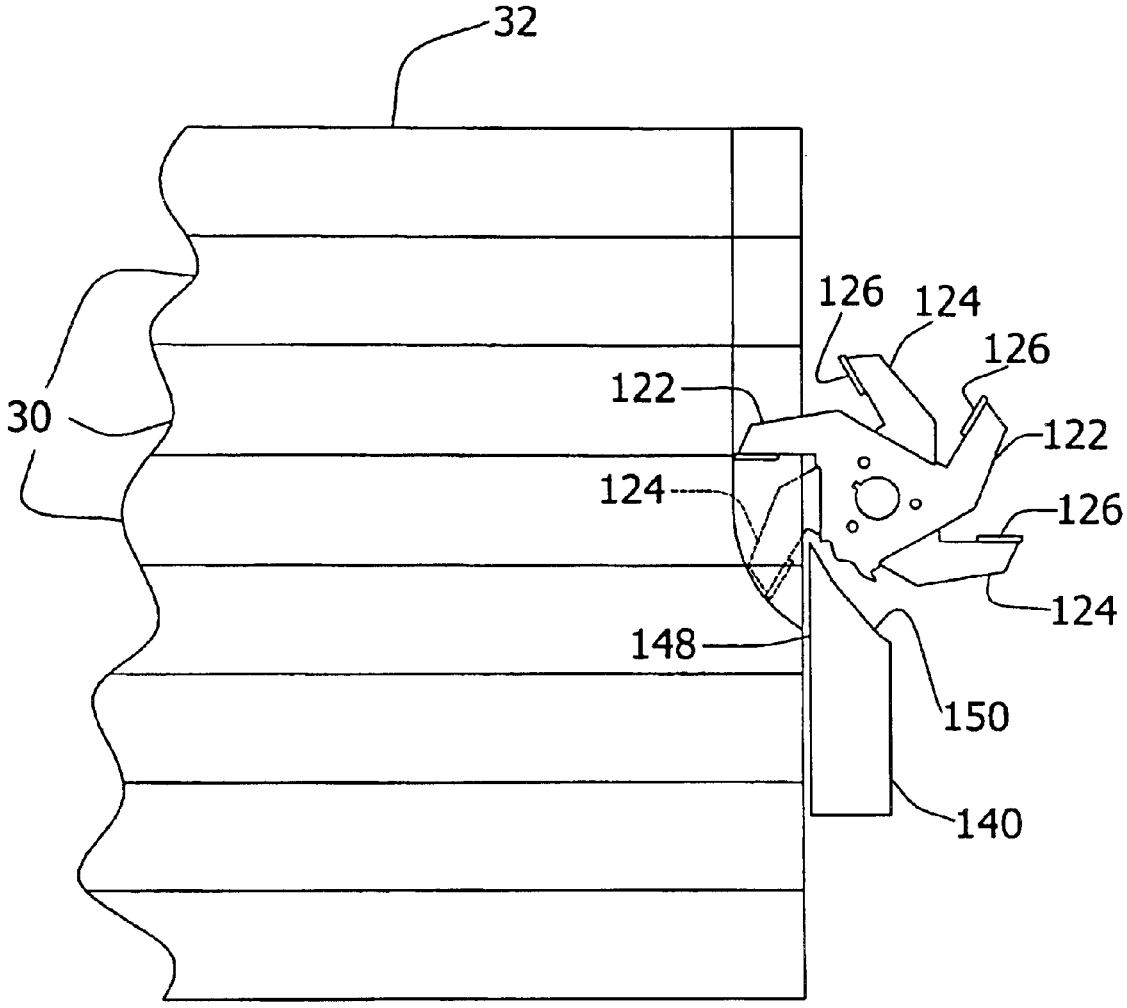
FIG. 11 is a schematic view in plan illustrating a stop bar of the apparatus.
Figure 12:
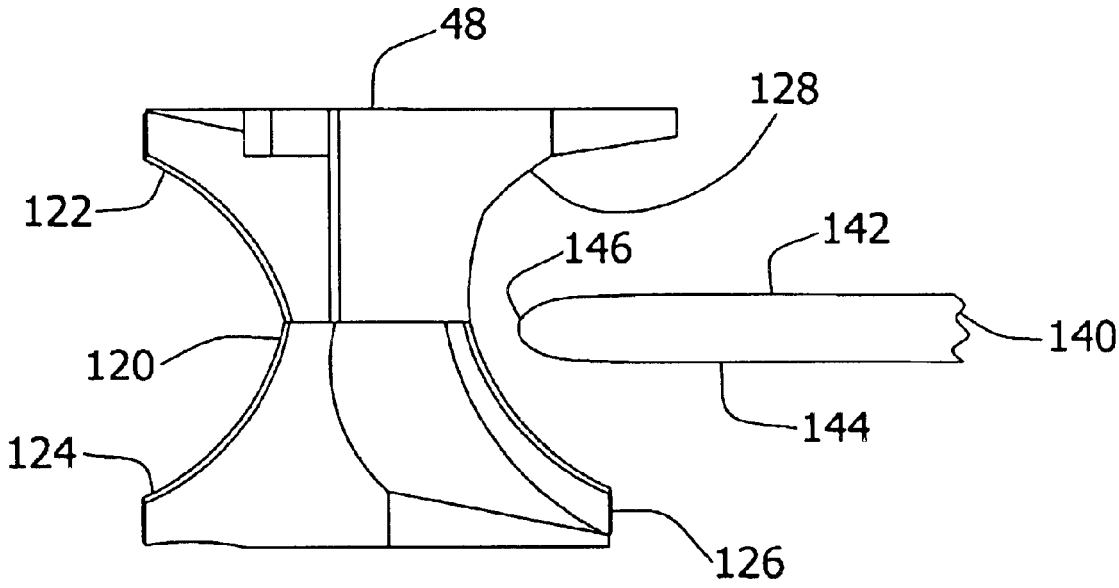
FIG. 12 is a view in elevation of a rotary cutter and stop bar of the invention.

Referring to FIGS. 10–12, the shaper 48 or cutter for rounding the ends of timbers 30 as they move forward has a hub 120 with six cutting arms extending outward from the hub in off-radial planes in a generally spiral configuration. There are three upper cutting arms 122 for shaping upper portions of timber ends and three lower cutting arms 124 for shaping lower portions of the ends. Each arm 122, 124 has a carbide blade 126 affixed thereto providing a cutting edge for the rounded end cutting. A concave recess 128 is defined generally along the hub 120, spaced between the upper and lower cutting arms 122, 124. The shaper 48 is keyed on shaft 130 (FIG. 10) extending down from an electric motor 132 operable to spin the shaper at relatively high speed. The motor 132 and a bearing (not shown) for the lower end of the shaft 130 are affixed on a motor/bearing mount adjustable horizontally and vertically with respect to the frame 52 for setting the shaper in accurate position. It will be appreciated that the configuration of the shaper, such as the general method of mounting and rotating the shaper or it arrangement, can be different without departing from the scope of the present invention.

The blades 126 of the shaper 48 impart forces on each timber 30 in a direction transverse to its intended path of motion. As the shaper 48 removes material from the timber (FIG. 11), the cutting arm 122 of 124 which initially engages the timber is at a position in its rotary motion where it is sweeping in a laterally outward direction with respect to the timber. Consequently, the timber 30 has a tendency to move laterally outward, away from the aligned row 32 of timbers and into a position between the upper and lower cutting arms 122, 124.

A stop bar 140 is mounted on the frame 52 on each lateral side for preventing movement of timbers 30 in a direction generally transverse the path of travel while the shaper or cutter 48 is shaping the end of the timber. The stop bar 140 is positioned immediately adjacent to the path of travel and configured for engagement by the end of the timber 30 if the timber should move in said transverse direction. It is positioned at an elevation between the guide bars 72, 74 and laterally offset therefrom. The stop bar 140 has generally flat, horizontal upper and lower surfaces 142, 144, and a downstream end 146 which extends into a position in the concave recess 128 of the shaper or cutter 48 without contacting the shaper such that the shaper may freely rotate without engaging the stop bar. The downstream end 146 of the stop bar 140 is positioned closely adjacent the hub 120 of the shaper, with a spacing between the downstream end and the hub being less than a width dimension of the timber 30 such that the timber is blocked from moving between the stop bar and the shaper. The spacing between the downstream end 146 of the stop bar and the hub 120 is preferably less than about 0.5 inches.

The stop bar 140 has a first lateral edge 148 (FIG. 11) which faces toward the path of travel and is generally parallel to the path of travel. That edge is generally flat and is engageable by timbers 30 to prevent lateral movement. The stop bar 140 has a second lateral edge 150 which faces toward the shaper or cutter 48 and is at a swept angle (FIG. 11) to avoid engagement by the shaper as the shaper rotates while being in close proximity thereto. The stop bar 140 can have other shapes or sizes and there can be additional stop bars at other positions along the path of travel without departing from the scope of this invention.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. An apparatus for shaping an end of a workpiece as the workpiece is advanced along a path of travel, the apparatus comprising:

a frame defining the path of travel for the workpiece;

a rotary cutter operatively connected to said frame and positioned laterally adjacent the path for engaging the workpiece as it moves along the path, the cutter having a hub with upper and lower cutting arms extending outwardly from the hub for shaping upper and lower portions, respectively, of said end of the workpiece, the cutting arms having arcuate cutting edges and generally defining a concave recess spaced between the upper and lower arms; and a stop bar mounted on the frame for preventing movement of the workpiece in a direction generally transverse the path of travel while the cutter is shaping the end of the workpiece, the stop bar positioned adjacent to the path of travel and configured for engagement by the end of the workpiece if the workpiece should move in said transverse direction;

wherein the stop bar has a downstream end which extends into the concave recess of the cutter without contacting the cutter for supporting the workpiece against lateral movement while the workpiece is being cut by the cutter.

2. An apparatus as set forth in claim 1 wherein the downstream end of the stop bar is positioned closely adjacent the hub of the cutter, with a spacing between the downstream end and the hub being less than a width dimension of the workpiece such that the workpiece is blocked from moving between the stop bar and the cutter.

3. An apparatus as set forth in claim 2 wherein the spacing between the downstream end of the stop bar and the hub of the cutter is less than about 0.5 inches.

4. An apparatus as set forth in claim 2 wherein the stop bar has a first lateral edge which faces toward the path of travel and is generally parallel to the path of travel, and a second lateral edge which faces toward the cutter, the second edge being shaped to avoid engagement by the cutter as the cutter rotates.

5. An apparatus as set forth in claim 4 wherein the stop bar has generally flat, horizontal upper and lower surfaces.

6. An apparatus as set forth in claim 1 wherein there are two cutters positioned on opposite lateral sides of the frame for shaping opposite ends of the workpiece, and two corresponding stop bars.

7. An apparatus as set forth in claim 1 wherein the cutter includes three upper cutting arms and three lower cutting arms, each arm extending outwardly from the hub in off-radial planes in a generally spiral configuration.

8. An apparatus as set forth in claim 1 wherein the frame includes an upper guide bar and a lower guide bar, the workpiece being disposed between the guide bars while moving along the path of travel, the stop bar being at an elevation between the guide bars.

9. An apparatus as set forth in claim 1 further comprising a pushing device operatively connected to said frame for advancing the workpiece along the path of travel.

10. An apparatus as set forth in claim 9 further comprising a conveyor on the frame for receiving workpieces thereon and delivering each workpiece sequentially to a loading position adjacent an upstream end of said path of travel for arranging workpieces into a row of workpieces along said path.

11. An apparatus as set forth in claim 10 wherein said pushing device is cyclically movable between an extended position wherein the pushing device engages a workpiece at an upstream end of the row to advance the row of workpieces along the path in the downstream direction, and a retracted position wherein a workpiece at said loading position may be deposited into the row at said endmost upstream position.

12. An apparatus as set forth in claim 11 further comprising a drive for simultaneously driving the conveyor and the pushing device, the drive being operatively connected to the conveyor for moving the conveyor continuously in generally unidirectional motion and operatively connected to the pushing device for moving the pushing device in reciprocating motion between the extended and retracted positions for moving the workpieces along the path.

13. An apparatus as set forth in claim 12 wherein the drive comprises a drive shaft.

14. An apparatus as set forth in claim 13 wherein the conveyor comprises an endless chain trained around sprockets.

15. An apparatus as set forth in claim 11 wherein the pushing device comprises a slidably mounted bar, and further comprising a rotatable disk engaged with and driven by the chain having an offset crank pin attaching a connecting rod, the connecting rod connected to the pushing device for moving the pushing device in reciprocating motion.

16. An apparatus as set forth in claim 15 further comprising at least one no-return prong positioned along the path of travel for preventing reverse movement of the row of workpieces.

* * * * *